US012201179B2

(12) United States Patent
McLellan et al.

(10) Patent No.: US 12,201,179 B2
(45) **Date of Patent: *Jan. 21, 2025**

(54) KNIT SHOES WITH ELASTIC REGION

(71) Applicant: Allbirds, Inc., San Francisco, CA (US)

(72) Inventors: Jamie McLellan, Sausalito, CA (US); Thomas Jad Finck, San Francisco, CA (US); Lisa Halbower-Fenton, Scituate, MA (US); James Romero, San Francisco, CA (US); Timothy Brown, San Francisco, CA (US); Dennice Quijano Barerra, San Francisco, CA (US); Talia Rapier, San Francisco, CA (US); April Gourdie, San Francisco, CA (US)

(73) Assignee: ALLBIRDS, INC., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/555,696

(22) Filed: Dec. 20, 2021

(65) Prior Publication Data

US 2022/0110415 A1 Apr. 14, 2022

Related U.S. Application Data

(63) Continuation of application No. 16/401,087, filed on May 1, 2019, now Pat. No. 11,206,899.

(51) Int. Cl.
*A43B 1/04* (2022.01)
*A43B 1/025* (2022.01)
(Continued)

(52) U.S. Cl.
CPC ..... *A43B 1/04* (2013.01); *A43B 1/025* (2022.01); *A43B 3/101* (2013.01); *A43B 3/107* (2013.01);
(Continued)

(58) Field of Classification Search
CPC ..... A43B 1/04; A43B 3/10; A43B 3/101; A43B 3/248; A43B 23/027; A43B 23/081; A43B 23/088
See application file for complete search history.

(56) References Cited

U.S. PATENT DOCUMENTS 1,176,572 A 3/1916 Lassig et al.
2,001,293 A * 5/1935 Wilson ..... D04B 1/106 66/171

(Continued)

FOREIGN PATENT DOCUMENTS

| | | |
|---|---|---|
| CN | 106913006 | 7/2017 |
| JP | 2015536207 | 12/2015 |
| WO | WO01/28377 | 4/2001 |

*Primary Examiner* — Sharon M Prange
(74) *Attorney, Agent, or Firm* — Schwabe, Williamson & Wyatt, P.C.

(57) ABSTRACT

A shoe may include an upper portion constructed from a continuous textile (e.g., a knit textile) that includes an elastic region and a structural region. The elastic region may be positioned about a perimeter of an opening into a cavity configured to receive a wearer's foot, and the elastic region may be configured to secure the shoe to a wearer's foot. The elastic region may have a first elasticity that is greater than a second elasticity of the structural region. In an unworn configuration, the elastic region may cause a tread surface of a sole of the shoe to have a continuous curvature. In a worn configuration, substantially all of an intermediate section of the tread surface may contact a surface on which the shoe is placed. The elastic region may improve the performance of the shoe, including the comfort and durability.

20 Claims, 12 Drawing Sheets

(51) Int. Cl.
*A43B 3/10* (2006.01)
*A43B 23/02* (2006.01)
*A43B 23/04* (2006.01)
*A43C 11/00* (2006.01)

(52) U.S. Cl.
CPC ..... *A43B 23/027* (2013.01); *A43B 23/042* (2013.01); *A43C 11/006* (2013.01)

(56) References Cited

U.S. PATENT DOCUMENTS 2,400,692 A * 5/1946 Herbert ..... D04B 1/108 66/171
2,798,311 A * 7/1957 Scholl ..... A43B 19/00 36/9 R
3,032,898 A * 5/1962 Servin ..... A43B 9/08 36/9 R
3,052,046 A * 9/1962 Kramer ..... A43B 3/108 36/9 R
3,243,901 A * 4/1966 Clarizio ..... A43B 17/16 D24/189
4,503,628 A * 3/1985 Mancinelli ..... A43B 23/28 36/58.6
4,642,916 A * 2/1987 Collins ..... A43B 23/08 36/58.6
6,931,762 B1 * 8/2005 Dua ..... A43B 23/042 66/185
7,168,190 B1 * 1/2007 Gillespie ..... A43B 3/24 363/31
9,961,962 B2 5/2018 Lee
10,227,717 B2 * 3/2019 Pedrini ..... D04B 9/46
10,757,996 B2 * 9/2020 Handorf ..... A43B 3/107
2006/0143767 A1 * 7/2006 Yang ..... B32B 7/04 442/76
2007/0022627 A1 2/2007 Sokolowski et al.
2012/0246973 A1 * 10/2012 Dua ..... A43B 23/0255 36/83
2014/0150292 A1 6/2014 Podhajny et al.
2014/0338226 A1 * 11/2014 Zavala ..... A43B 1/04 36/83
2015/0059209 A1 * 3/2015 Dekovic ..... D04B 1/104 36/84
2016/0073737 A1 * 3/2016 Fu ..... A43B 23/28 36/58.6
2017/0016156 A1 1/2017 Pedrini
2017/0105484 A1 4/2017 Jancuska et al.
2020/0068991 A1 * 3/2020 Steere, Jr. ..... A43B 3/24

* cited by examiner

KNIT SHOES WITH ELASTIC REGION

CROSS-REFERENCE TO RELATED APPLICATION(S)

This application is a continuation patent application of U.S. patent application Ser. No. 16/401,087, filed May 1, 2019 and titled "Knit Shoes with Elastic Region," the disclosure of which is hereby incorporated herein by reference in its entirety.

FIELD

Embodiments described herein relate to footwear, and in particular, to shoes having features as described herein.

BACKGROUND

Shoes are widely used for protecting and providing comfort to wearers' feet. Traditional shoes include an upper portion that is formed by attaching multiple separate components together. In some cases, the design of traditional shoes adds complexity to the manufacturing process, for example by requiring multiple steps related to assembly of the upper portion. In some cases, traditional shoes are constructed entirely from synthetic materials, the production and use of which may be harmful to the environment and may prevent the shoes from being recycled.

SUMMARY

Certain embodiments described herein generally relate to, include, or take the form of a shoe comprising a sole and an upper portion. The sole defines a tread surface and a top surface opposite the tread surface. The upper portion is attached to the top surface of the sole and cooperates with one or more additional components of the shoe to define a cavity. The upper portion includes an elastic region at least partially surrounding an opening into the cavity and defining at least a portion of a perimeter of the opening. The elastic region has a first elasticity. The upper portion further includes a structural region at least partially surrounding the elastic region and having a second elasticity that is less than the first elasticity. An exterior surface of the upper portion is defined by a continuous knit textile comprising eucalyptus fiber.

Other embodiments described herein may relate to a shoe that includes a sole and an upper portion. The sole defines a tread surface and a top surface opposite the tread surface. The upper portion is attached to the sole and defines an exterior surface formed from a continuous knit textile. The upper portion includes an elastic region comprising an elastic polymer and defining an opening in the upper portion. The upper portion further includes a structural region at least partially surrounding the elastic region and comprising eucalyptus fiber. The upper portion defines a boundary between the elastic region and the structural region, and the elastic region has a ribbed knit pattern defining ribs that extend from the boundary toward a perimeter of the opening.

Still other embodiments described herein may relate to a shoe that includes a sole and an upper portion. The sole defines a front tip of the shoe, a rear tip of the shoe, a front lobe having a first width that continuously increases along a path extending from the front tip to a first maximum width location, a rear lobe having a second width that continuously increases along a path extending from the rear tip to a second maximum width location, a tread surface extending between the front tip and the rear tip, and a top surface opposite the tread surface. The tread surface includes a forward section extending from the front tip of the shoe to the first maximum width location, a rear section extending from the rear tip of the shoe to the second maximum width location, and an intermediate section between the forward section and the rear section. The upper portion is attached to the top surface of the sole and includes an elastic region defining an opening into a cavity of the shoe. The elastic region extends around a perimeter of the opening and is configured to exert an elastic force on the sole. The upper portion further includes a structural region at least partially surrounding the elastic region. In an unworn configuration in which the shoe is positioned on a planar surface, the forward section and the rear section are elevated from the planar surface.

BRIEF DESCRIPTION OF THE DRAWINGS

Reference will now be made to representative embodiments illustrated in the accompanying figures. It should be understood that the following descriptions are not intended to limit this disclosure to one preferred embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Figure 1A:
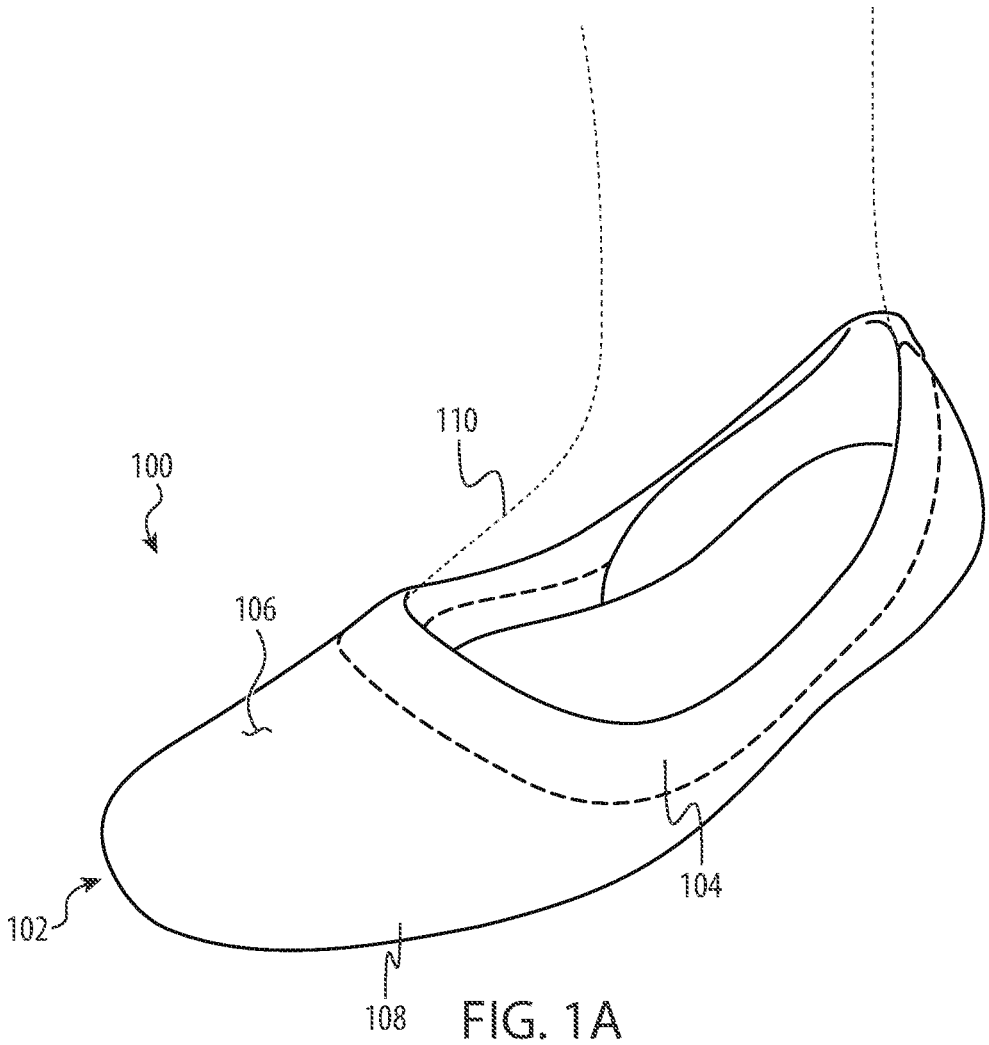
FIG. 1A illustrates an example shoe having an elastic portion and in a worn configuration.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the claims.

The shoes described herein include various features to improve performance, increase manufacturing efficiency, and provide environmental benefits over traditional shoes. In some cases, a shoe includes an upper portion (e.g., a knit upper portion) constructed from a continuous textile (e.g., a continuous knit textile) that includes an elastic region having different textile properties from a structural region to improve the performance of the shoe, including durability and comfort. The knit upper portion may define a continuous single exterior surface around an opening to a cavity with one seam and no holes through the knit textile forming the upper portion. The elastic region may retain the shoe to a wearer's foot in the absence of laces or other fastening mechanisms common on traditional footwear. Likewise, the elastic region (and the knit upper portion) may stretch to allow a user's foot to enter the shoe, then contract to retain the shoe on the foot.

In some cases, the shoes described herein may be constructed at least partially using bio-based materials. As used herein, the term "bio-based materials" may refer to materials made from substances derived from living or once-living organisms. In some cases, the upper portion includes a bio-based material, such as eucalyptus fiber, in yarn used to knit the upper portion. In some cases, other components of the shoes may include bio-based materials. For example, a sole of the shoe may include a bio-based foam material made using sugarcane and the insole of the shoe may include a bio-based foam material made using castor bean oil. In some cases, the shoes described herein may be constructed at least partially using recycled materials. For example, the elastic region may include a polymer (e.g., polyester) formed at least partially from recycled material.

In various embodiments, the bio-based and recycled materials used in the shoes described herein provides significant environmental benefits over traditional shoes. Using bio-based materials as a substitute for synthetic materials may result in fewer harmful emissions associated with manufacturing the shoe by reducing or eliminating processing of harmful chemicals, such as the petroleum products used to manufacture most synthetic fibers. Similarly, bio-based materials are more ecologically sustainable than many synthetic materials because they are derived from renewable resources (e.g., plant fibers, sugarcane, corn sugar) rather than nonrenewable resources (e.g., petroleum products). Eucalyptus fiber is particularly environmentally friendly and sustainable, because eucalyptus trees typically do not require irrigation or pesticides, and can be grown in areas that are not suitable for other farming uses. Similarly, using recycled materials instead of new materials reduces waste sent to landfills and incinerators and conserves natural resources, prevents pollution, and saves energy related to the collection and processing of new raw materials.

In addition to using bio-based and recycled materials, the shoes described herein may include various features to make recycling the shoes easier. For example, the shoe may have fewer components to separate from one another as part of the recycling process, for example as a result of upper portion being formed from a continuous textile.

In various embodiments, the upper portion is attached to a first side of a sole that defines, on a second opposite side, a tread surface that is adapted to contact the ground or other surfaces while the shoe is worn. The sole may be attached to the upper portion, for example using an adhesive. The shoe may define a cavity adapted to receive a wearer's foot. In some cases, an insole may be positioned in the cavity. In some cases, the insole cooperates with the upper portion to define the interior surface of the shoe.

As noted above, in addition to the environmental benefits, the shoes described herein may provide improved performance as compared to many traditional shoes. In various embodiments, the features described herein may improve the durability of the shoe, the comfort of the shoe, and/or allow a wearer to comfortably wear the shoe with or without socks. In some cases, the upper portion includes an elastic region and a structural region. In some cases, the elastic region is configured to secure the shoe to a wearer's foot. The elastic region may have a higher elasticity than the structural region. As used herein, "elasticity" may refer to a measure of the ability or tendency of a material or combination of materials to elastically deform under an applied stress. Likewise, the term "elastically deform" may refer to the ability or tendency of a material to change size or shape under an applied stress (e.g., force) and return to substantially its initial size or shape after the applied stress is removed.

In some cases, the elastic region exerts an elastic force on other components of the shoe. As used herein, "elastic force" may refer to a force exerted by an elastically deformable material as it is stretched or compressed from a default size or shape. In some cases, the elastic region exerts an elastic force on the structural region or the sole of the shoe. In an unworn configuration in which the shoe is not worn by a wearer, the elastic force may cause the sole of the shoe to curve. In some cases, in an unworn configuration, a tread surface of the sole is substantially continuously curved between a front tip of the shoe and a rear tip of the shoe.

In some cases, in a worn configuration (e.g., in which the shoe is worn by a wearer), substantially all of an intermediate section of the traction surface (as defined below) may contact a surface on which the shoe is placed. Further, while in a worn configuration, the elastic region may help to secure the shoe to the wearer's foot, which may improve the fit and comfort of the shoe, for example by reducing rubbing or other problems associated with poor fit. For example, an elastic force exerted on the sole by the elastic region may pull the sole toward the wearer's foot and/or hold the sole against the wearer's foot. In some cases, the elastic region is positioned at least partially around and/or defines an opening of a cavity adapted to receive a user's foot. The elastic region may exert a compressive force on the wearer's foot or leg to hold the shoe on the wearer's foot and/or prevent the user's foot from inadvertently slipping out of the cavity, which may improve the comfort and/or durability of the shoe.

Some traditional shoes use separate components to secure a shoe to a wearer's foot or to achieve desired comfort characteristics, such as a strap with a clasp or other fastener or an elastic band sewn into an upper portion. Providing an elastic region of an upper portion formed by a continuous textile provides numerous advantages over traditional methods, including increasing manufacturing efficiency by reducing manufacturing steps and eliminating components, and making recycling easier by requiring less deconstruction of the shoe to prepare it for recycling. In addition, the ability for the sole to bend in response to the elastic force(s) applied by the elastic region reduces an amount that the elastic region is stretched in the unworn configuration, which improves the durability of the shoe by allowing the elastic region to maintain its elasticity for longer.

In some cases, the upper portion may cooperate with one or more additional shoe components to define a cavity for receiving a wearer's foot. In some cases, the upper portion defines an opening to the cavity and a perimeter around the opening. The elastic region may at least partially surround the opening. In some cases, the elastic region extends at least partially around the perimeter of the opening. Additionally, the elastic region may define the opening and/or the perimeter. In some cases, the elastic region extends around an entirety of the perimeter of the opening.

Some traditional footwear designs are uncomfortable for wearers because shoes do not extend far enough up a wearer's foot to provide ample support. For example, in some traditional footwear designs, it may be challenging to provide sufficient support and comfort for shoes that do not cover part(s) of the wearer's foot that includes metatarsal bones. The elastic region(s) described herein provide foot support, for example by exerting compressive force on the wearer's foot, which may contribute to increased comfort for the wearer. In some cases, the opening in the cavity is positioned at least partially over a part of the wearer's foot that includes metatarsal bones. The elastic region may maintain the comfort of the shoe while maintaining the opening that does not cover all of the part of the wearer's foot that includes metatarsal bones. Similarly, the structural region of the upper portion may have an associated elasticity that allows the structural region to exert a compressive force on the wearer's foot, thereby further supporting the wearer's foot.

The elastic region may be formed at least partially using a ribbed knit pattern that defines ribs along one or more surfaces of the elastic region. In some cases, the ribs may extend from a boundary between the structural region and the elastic region to the perimeter of the opening. In some cases, some or all of the ribs extend from the boundary toward the perimeter, but do not reach the perimeter. In some cases, in a curved section of the elastic region, some of the ribs extend from the boundary to the perimeter, and some of the ribs do not extend all the way to the perimeter from the boundary. The presence of ribs that do not extend all the way to the perimeter may improve the comfort and durability of the shoe by allowing the curved section of the elastic region to lay flat against a wearer's foot instead of forming creases or bends in a curved part of the elastic region.

The shoe may include one or more linings to improve the comfort and/or durability. A toe lining and a heel lining may reduce wear on the upper portion, for example by reducing abrasion in areas that are prone to greater amounts of friction from a wearer's foot. In some cases, the heel lining may additionally or alternatively provide friction to retain the wearer's foot in the shoe during wear. In some cases, at least a portion of the heel lining is positioned along and attached to one or more portions of the elastic region. The heel lining being positioned along and attached to the portion(s) of the elastic region constrains an elasticity of those portions of the elastic region, for example by preventing the constrained part(s) from stretching as much as other portions of the elastic region, or at all. In certain embodiments, part of the constrained part(s), such as a top or upper piece, may stretch (e.g., elastically deform) to some extent while a remainder of the constrained part(s) does not stretch, or stretches a negligible amount. This may improve the performance of the shoe, including the comfort and durability. For example, the constrained elastic region elasticity may maintain or reinforce a structure of the areas of the upper portion around the rear of the shoe, which may result in increased comfort and/or durability of the shoe.

In some cases, the continuous textile includes one or more layers. An outer layer of the continuous textile may define at least a portion of the exterior surface of the upper portion, and an inner layer of the continuous textile may define at least a portion of the interior surface of the upper portion. The textile properties of the interior surface may be different than the textile properties of the exterior surface. For example, the interior surface may be brushed, flocked, or otherwise have different textile properties to soften a tactile feel of the interior surface. The interior surface may include one or more different materials than the exterior surface. For example, the textile may include different fiber types or fiber ratios making up the interior surface as compared to the exterior surface. The above-mentioned features may provide particular advantages to wearers wearing the shoes without socks, including comfort, friction, retention, and feel, because the wearer's foot may directly contact the upper portion while the shoes are worn.

In some cases, the shoe is designed to allow a wearer to wear the shoe without socks. The shoe may include features to improve the performance of the shoe when worn without socks. The upper portion may improve the comfort of the shoe by reducing or eliminating internal (and/or external) seams in the continuously knit material that may irritate wearers, especially when lacking socks. In some cases, the upper portion defines an interior surface of a cavity adapted to receive a wearer's foot in addition to defining an exterior surface of the shoe.

As used herein, "textile" or "fabric" may refer to a flexible material consisting of a network of natural and/or artificial fibers (e.g., yarn or thread formed into a sheet) formed by any suitable process, including, but not limited to, weaving, knitting, spreading, crocheting, knotting, felting, bonding, braiding, and carpeting. A "knit textile" may refer to a textile formed by knitting, and consists of consecutive rows of intermeshing loops or stitches. A "continuous textile" may refer to a textile that is knit or otherwise formed as a single, unitary piece, in which an entire top surface is defined by a single piece and an entire bottom surface is defined by a single piece. The pieces that define the top surface and the bottom surface may be different layers of the textile, or one piece may define the entire top surface and the entire bottom surface. As a result, a continuous textile does not have multiple adjacent sections with seams therebetween. In various cases, a continuous textile may be attached to itself using a seam, for example to define a structure of the upper portion.

As used herein, "textile properties" may refer to properties that define the dimensions and characteristics of a textile, including, but not limited to, fiber properties (e.g., fiber type, size, and length), yarn properties (e.g., yarn diameter, twist, weight, size, count, fiber content or fiber ratio, ply, and strand count in plied yarn), weight, thickness, fabric structure, fabric density, weave properties (e.g., weave type, warp and filling yarn count), knit properties (e.g., knit type, wale and course count), finishes (e.g., chemicals, resins, starches, and waxes), and mechanical effects (e.g., calendaring, napping, flocking, and brushing).

As used herein, "textile characteristics" may refer to measures of the textile's performance, including, but not limited to, stiffness (e.g., resistance to stretching or bending), flexibility (e.g., reduced stiffness), elasticity, breathability (e.g., air permeability), water resistance, moisture wicking, odor resistance, durability characteristics, visual characteristics (e.g., textile appearance), and tactile characteristics (e.g., textile feel). As used herein, the term "durability" may refer to the ability of materials (e.g., a textile) or objects (e.g., a shoe) to resist wear, deformation, and/or damage and/or to maintain its textile properties, structure, visual characteristics, and/or tactile characteristics. As used herein, "durability characteristics" may refer to measures of a textile's durability, including, but not limited to, abrasive strength (e.g., resistance to abrasion), bursting strength (e.g., ability to withstand forces applied at right angles to the plane of the fabric), and tensile strength (e.g., ability to withstand forces applied along the plane of the fabric).

FIG. 1A illustrates an example shoe 100 having a knit textile upper portion 102 in a worn configuration (e.g., corresponding to the shoe being worn by a wearer). The upper portion 102 may define a part of a shape or structure of the shoe 100, and may be adapted to contain, comfort, and/or protect a foot of a wearer wearing the shoe 100. As described above, the shoe 100 may include an upper portion 102 constructed from a continuous textile (e.g., a knit textile) that defines one or more elastic regions 104 and one or more structural regions 106 that may improve performance of the shoe, including durability and comfort. One or more textile properties may be varied across different regions of the upper portion 102 to achieve desired textile characteristics for each region to achieve desired shoe performance. For example, the elastic region 104 may include an elastic material to increase the elasticity of the elastic region.

As noted above, the elastic region 104 may have a higher elasticity than the structural region 106. In some cases, the elastic region 104 exerts an elastic force on other components of the shoe 100. In the worn configuration, the elastic region 104 may help to secure the shoe 100 to the wearer's foot 110, which may improve the fit and comfort of the shoe, for example by reducing rubbing, shifting, or other problems associated with poor fit.

Figure 1B:
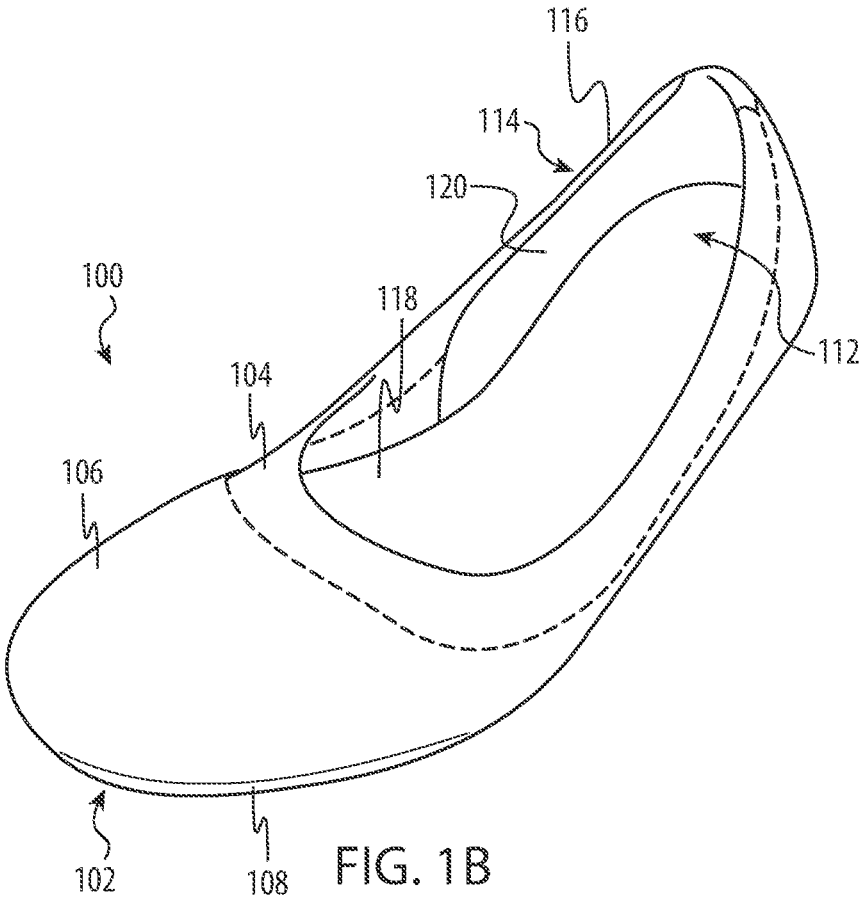
FIG. 1B illustrates the example shoe of FIG. 1A in an unworn configuration.

The upper portion 102 may cooperate with one or more additional shoe components to define a cavity for receiving a wearer's foot 110 (e.g., cavity 112 shown in FIG. 1B). In some cases, the elastic region 104 is positioned at least partially around an opening of the cavity. The elastic region 104 may exert a compressive force on the wearer's foot 110 or leg to hold the shoe 100 on the wearer's foot and/or prevent the wearer's foot from inadvertently slipping out of the cavity, which may improve the comfort and durability of the shoe.

The shoe 100 may include a sole 108 that is attached to the upper portion 102 and defines a tread surface that is adapted to contact the ground or other surfaces while the shoe is worn. The upper portion 102 may define a first part of an exterior surface of the shoe 100, and a sole 108 may define a second part of the exterior surface of the shoe. In some cases, the elastic region 104 exerts an elastic force on the sole 108, which pulls the sole toward the wearer's foot 110 and/or holds the sole against the wearer's foot. This may improve comfort and durability of the shoe 100 by reducing movement of the wearer's foot 110 inside the shoe.

As described in more detail below, in some cases, in a worn configuration, substantially all of an intermediate section of the tread surface may contact a surface on which the shoe is placed (e.g., the intermediate section may be coplanar with a surface on which the shoe 100 is positioned). As described in more detail below, in an unworn configuration in which the shoe 100 is not worn by a wearer, the elastic force may cause the sole 108 of the shoe 100 to curve. In various embodiments, the components of the shoe 100, including the sole 108, must be sufficiently thin, pliable, and/or flexible to be curved by the elastic force exerted by the elastic region 104. In some cases, sipe features (discussed below with respect to FIG. 2B) may increase a flexibility of the sole 108.

The structural region 106 may at least partially surround the elastic region 104 and define a part of a shape or structure of the shoe 100. The structural region 106 may be adapted to contain, comfort, and/or protect a foot of a wearer wearing the shoe 100. In the worn configuration, the structural region 106 may at least partially surround the wearer's foot 110.

FIG. 1B illustrates the example shoe 100 in an unworn configuration (e.g., in which the shoe is not worn by a wearer). As noted above, the upper portion 102 may cooperate with one or more additional shoe components to define a cavity 112 for receiving a wearer's foot (e.g., wearer's foot 110 shown in FIG. 1A). The upper portion 102 may define an opening 114 to the cavity 112 and a perimeter 116 around the opening. As shown in FIG. 1B, the elastic region 104 may at least partially surround the opening 114. In some cases, the elastic region 104 extends at least partially around the perimeter 116 of the opening 114. In some cases, the elastic region 104 defines the opening 114 and/or the perimeter 116. In some cases, the elastic region 104 extends around an entirety of the perimeter 116 of the opening 114.

Some traditional footwear designs are uncomfortable for wearers because shoes do not extend far enough up a wearer's foot to provide ample support. For example, in some traditional footwear designs, it may be challenging to provide sufficient support and comfort for shoes that do not cover part(s) of the wearer's foot that includes metatarsal bones. The elastic region 104 provides foot support, for example by exerting compressive force on the wearer's foot 110, which may contribute to increased comfort for the wearer. In some cases, the opening 114 in the cavity 112 is positioned at least partially over a part of the wearer's foot 110 that includes metatarsal bones. The elastic region 104 may maintain the comfort of the shoe while maintaining the opening 114 that does not cover all of the part of the wearer's foot 110 that includes metatarsal bones. Similarly, the structural region 106 of the upper portion may have an associated elasticity that allows the structural region to exert a compressive force on the wearer's foot 110, thereby further supporting the wearer's foot.

Figure 3A:
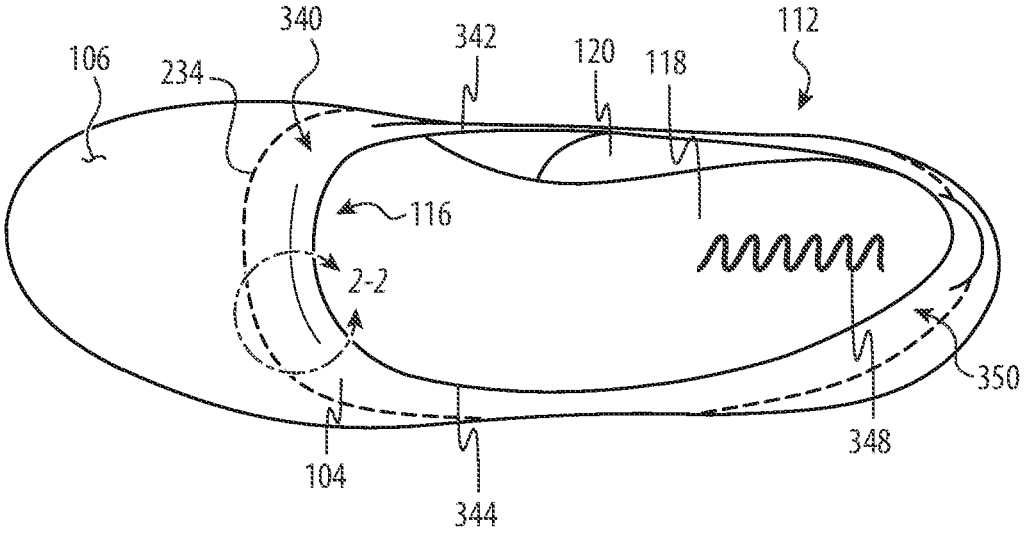
FIG. 3A illustrates a top view of the example shoe of FIG. 1A.

In some cases, the shoe 100 includes an insole 118 positioned in the cavity, as discussed in more detail below with respect to FIG. 3A. In some cases, the shoe 100 includes a heel lining 120 and/or a toe lining (not shown in FIG. 1B), as discussed in more detail below with respect to FIG. 5.

Additionally, the upper portion 102 may define a first part of an interior surface of the shoe 100. As noted above, the upper portion 102 may include one or more layers. In some cases, an outer layer of the upper portion 102 defines at least a portion of the exterior surface of the upper portion, and an inner layer of the upper portion defines at least a portion of the interior surface of the upper portion. In some cases, textile characteristics may vary between the interior surface and the exterior surface to achieve desired shoe performance. Additionally, textile characteristics and materials may vary at different locations on the interior surface.

As noted above, whereas many traditional shoes include upper portions formed from multiple different parts or components, in some cases, the upper portion 102 is formed from a continuous textile. The formation of the upper portion 102 using a continuous textile provides numerous advantages, including improving the comfort of the shoe 100 by removing seams that may irritate a wearer, and improving manufacturing efficiency by reducing the overall number of components in the shoe.

In various embodiments, the continuous textile that is used to form the upper portion 102 may be constructed by any suitable process, including, but not limited to, weaving, knitting, spreading, crocheting, knotting, felting, bonding, braiding, and carpeting. In some cases, the continuous textile is a knit textile. The knit textile may be knit or otherwise formed into a particular shape (e.g., the shape of the upper portion 102 shown in FIG. 6). In some cases, the continuous textile is knit into a three-dimensional shape (e.g., a non-planar shape). In some cases, the continuous textile is cut or otherwise formed into the proper shape after it is constructed. In various embodiments, different regions, such as the elastic regions and structural regions have different textile properties to achieve different textile characteristics.

As noted above, the knit textile may include one or more layers that are attached together. In some cases, a first layer may have a first knit structure having first textile properties and a second layer may have a second knit structure having second textile properties. In some cases, multiple layers are formed together as part of a knitting process. The first and second layers may be interlaced with one another. For example, the knit structure of the first layer may be interlaced with the knit structure of the second layer, for example using the loop transfer technique.

The continuous textile may be formed of any suitable material or combination of materials. For example, a woven or knit textile may be formed using one or more types of yarn. The yarn may be formed using one or more natural or synthetic fibers twisted or otherwise bound together. Example fibers include cellulose fibers (e.g., eucalyptus fiber, bamboo fiber, rayon, and modal), wool, cotton, silk, polyester, nylon, and the like. In some cases, the yarn is formed using a blend of two or more fibers. For example, the yarn may be a blend of eucalyptus fiber and polyester. In some cases, the yarn is a plied yarn that includes multiple strands of yarn twisted or braided together.

The continuous textile used to form the upper portion 102 may contribute to an increased ability for the shoe 100 to maintain its shape in the unworn configuration. For example, the knit structure(s) of the upper portion 102 may provide sufficient rigidity to avoid folding, wrinkling, and other deformation of the shoe 100 in the unworn configuration. Additionally, the continues textile may define a relatively small exterior surface 102*a* of the upper portion 102 compared to traditional shoes, such as sneakers. The relatively small exterior surface 102*a* may contribute to the increased ability for the shoe 100 to maintain its shape in the unworn configuration. For example, a larger surface area may be more likely to collapse as gravity or forces from wear (e.g., stretching) act on it, whereas a smaller surface area may be subject to fewer or smaller such forces and/or less likely to collapse under such forces.

Additionally or alternatively, the elastic region 104 may contribute to the increased ability for the shoe 100 to maintain its shape in the unworn configuration. For example, the elastic region 104 may exert forces (e.g., an elastic force) on other regions of the upper portion 102 (e.g., the structural region 106) to maintain the shape of the shoe 100 in the unworn configuration. This may provide numerous advantages over traditional shoe designs, including avoiding creases or wrinkles on the shoe 100 and maintaining the stability and structural integrity of the shoe over time. The additional structural support provided by the continuous textile may also increase the comfort of the shoe 100 when the shoe is worn.

Figure 2A:
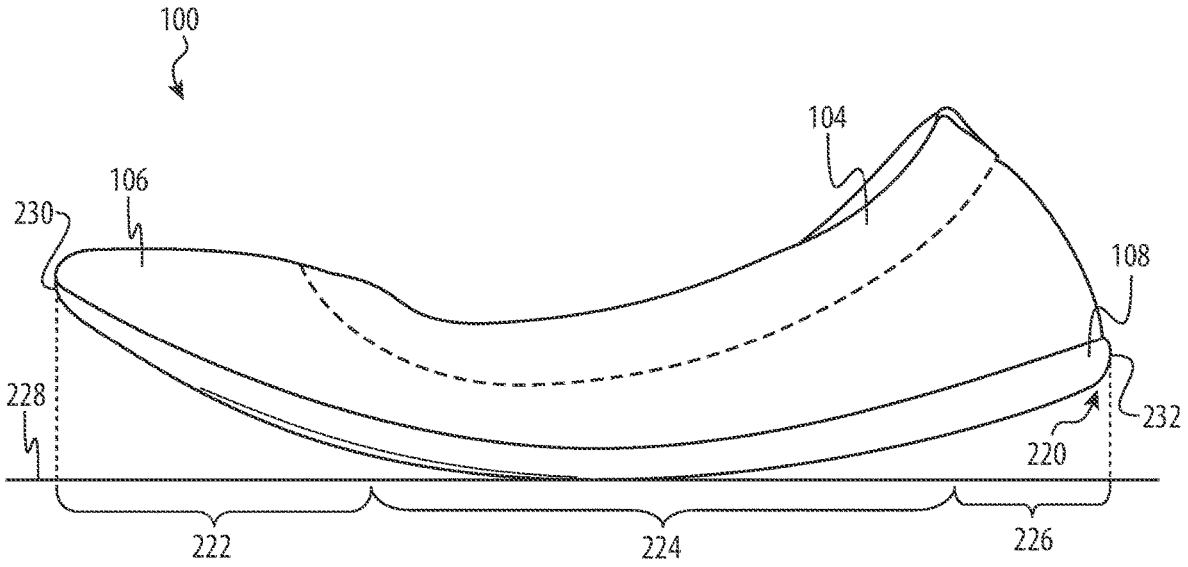
FIG. 2A illustrates a side view of the example shoe of FIG. 1A in an unworn configuration.

FIG. 2A illustrates the example shoe 100 in an unworn configuration. As noted above, in some cases, in an unworn configuration, the elastic region 104 may exert an elastic force on the sole 108 that causes the sole 108 to curve. For example, in some cases, the elastic force exerted by the elastic region 104 places the tread surface 220 in tension, and places a top surface of the sole 108 in compression, causing the sole 108 to curve.

Is some cases, the sole 108 may define a front tip 230 of the shoe 100 and a rear tip 232 of the shoe, and the tread surface 220 may extend between the front tip and the rear tip. As shown in FIG. 2A, the curve of the tread surface 220 of the sole 108 may be substantially continuous between the front tip 230 and the rear tip 232. As used herein, a "substantially continuous curve" may refer to a surface or a portion of a surface that is curved in a single direction (e.g., convex or concave) along substantially (e.g., about 80% or more, about 90% or more, or even 95% or more) its entire length. In some cases, the degree of curvature may change along the length of a substantially continuously curved surface.

Figure 2B:
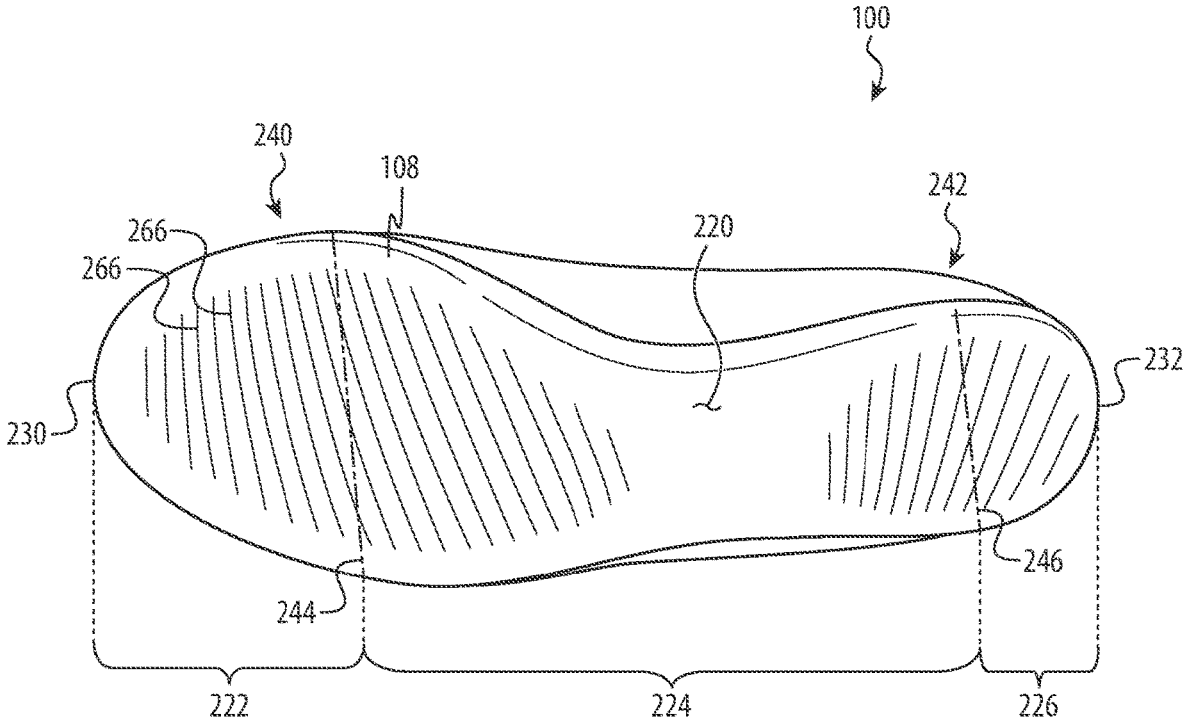
FIG. 2B illustrates a bottom view of the example shoe of FIG. 1A.

As noted above, the sole 108 may define a tread surface 220 that is adapted to contact the ground or other surfaces while the shoe is worn. FIG. 2B illustrates a bottom view of the example shoe 100 showing the example tread surface 220 on the sole 108. The sole 108 may define a front lobe 240 and a rear lobe 242 separated by a comparatively narrow region of the sole. The front lobe 240 may have a first width that continuously (or near-continuously) increases along a path extending from the front tip 230 to a first maximum width location 244, which generally corresponds to a part of the shoe that receives a ball of a wearer's foot. The rear lobe 242 may have a second width that continuously increases along a path extending from the rear tip 232 to a second maximum width location 246, which generally corresponds to a widest part of a heel of the shoe.

The tread surface 220 may define a forward section 222 between the front tip 230 and the first maximum width location 244, a rear section 226 between the rear tip 232 and the second maximum width location 246, and an intermediate section 224 between the forward section and the rear section. Returning to FIG. 2A, the shoe 100 is positioned with a planar surface 228 (e.g., the ground or another surface) contacting the tread surface 220 of the sole 108. As shown in FIG. 2A, in the unworn configuration, a portion of the intermediate section 224 contacts the planar surface 228, and an entirety of the forward section 222 and an entirety of the rear section 226 are elevated from (e.g., separated from) and do not contact the planar surface 228. In some cases, the elastic force exerted by the elastic portion 104 elevates the forward section 222 and the rear section 226 from the planar surface 228. For example, a component of the elastic force may pull the front tip 230 and the rear tip 232 of the sole inward toward the center of the shoe 100.

In some cases, at least a part of the forward section 222 of the tread surface 220 is elevated between about two and about five centimeters in the unworn configuration. In some cases, at least a part of the forward section 222 of the tread surface 220 is elevated more than about three centimeters in the unworn configuration. In some cases, at least a part of the rear section 226 of the tread surface 220 is elevated between about one and about three centimeters in the unworn configuration. In some cases, at least a part of the rear section 226 of the tread surface 220 is elevated more than about two centimeters in the unworn configuration.

Figure 2C:
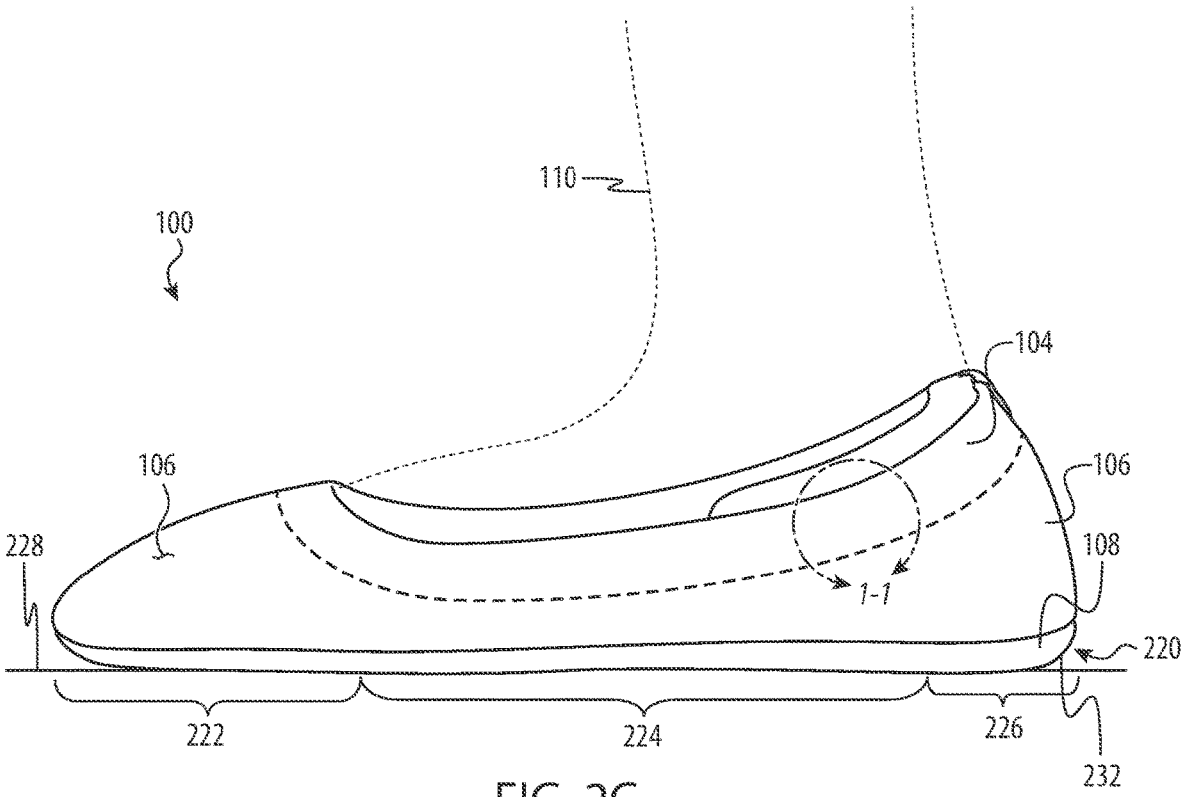
FIG. 2C illustrates a side view of the example shoe of FIG. 1A in a worn configuration.

FIG. 2C illustrates the example shoe 100 in a worn configuration. As noted above, in a worn configuration, substantially all (e.g., about 80% or more, about 90% or more, or even about 95% or more) of the intermediate section 224 of the tread surface 220 of the sole 108 may contact the surface 228 (e.g., the intermediate section may be coplanar with the planar surface 228). In some cases, the presence of a wearer's foot 110 in the shoe 100 counteracts the elastic force exerted by the elastic region 104 and causes the tread surface 220 to be substantially planar in the intermediate section 224. For example, in some cases, the intermediate section 224 of the tread surface 220 does not deviate from a reference plane by more than about 0.5 centimeters at any location along the tread surface. In some cases, the intermediate section 224 of the tread surface 220 does not deviate from a reference plane by more than about 0.25 centimeters at any location along the tread surface.

In the example shown in FIG. 2C, in a worn configuration, the elastic region 104 may still exert an elastic force on other components of the shoe 100, such as the structural region 106 or the sole 108, which may improve the comfort and durability of the shoe 100. For example, in some cases, the elastic region 104 exerts a force that is transmitted through the structural region 106 that pulls the sole 108 toward the wearer's foot 110 and/or holds the sole against the wearer's foot. This may secure the shoe 100 to the wearer's foot 110 and/or improve comfort and durability of the shoe 100 by reducing movement of the wearer's foot 110 inside the shoe.

Figure 2D:
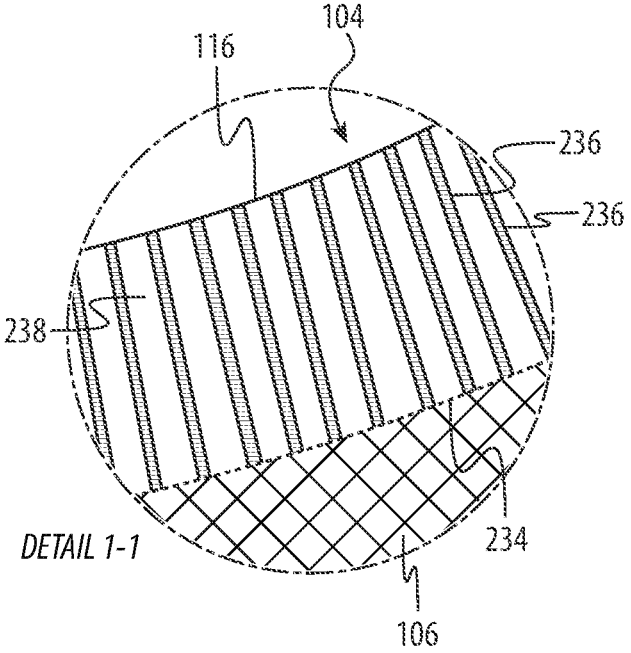
FIG. 2D illustrates a detail view of area 1-1 of FIG. 2B.

As noted above, the elastic region 104 may be formed at least partially by a ribbed knit pattern that defines a set of ribs along one or more surfaces of the elastic region. FIG. 2D illustrates a detail view of section 1-1 of FIG. 2C. As shown in FIG. 2D, the elastic region 104 may include ribs 236 and depressions 238 between the ribs. The ribs 236 may be raised relative to the depressions 238. Likewise, the depressions 238 may be depressed relative to the ribs 236. In some cases, as shown in FIG. 2D, the ribs 236 extend from a boundary 234 between the structural region 106 and the elastic region 104 to the perimeter 116 of the opening 114. In some cases, some or all of the ribs 236 extend from the boundary 234 toward the perimeter 116, but do not reach the perimeter. In some cases, some of the ribs 236 extend all the way to the perimeter 116, and some of the ribs do not extend all the way to the perimeter, as discussed in more detail below with respect to FIG. 3B.

In various embodiments, the orientation of the ribs 236 (e.g., extending from the boundary 234 toward the perimeter 116) may provide advantages, including increasing a comfort of the shoe 100 on a wearer's foot. For example, the ribs 236 allow stretching in a transverse direction normal to the direction of the ribs (e.g., left and right with respect to FIG. 2D). The transverse stretching of the ribs 236 may avoid the elastic region 104 being too tight on a user's foot. The width of the elastic region 104 (e.g., the length of the ribs 236) may be sufficient to allow the elastic region to remain snug to secure the shoe 100 to the wearer's foot. The transverse stretching of the ribs 236 may provide or enhance the ability to adjust a size of the opening 114 to accommodate differently-sized feet (e.g., feet having different widths). Additionally, in some cases, the ribs 236 are substantially parallel to a majority of blood vessels in parts of a wearer's foot covered by the elastic region 104, which avoids instances in which the ribs 236 cross over a vein and potentially inhibit blood flow through the vein. The ribs 236 may allow stretching in other directions besides the transverse direction normal to the direction of the ribs. For example, the ribs 236 may allow stretching in a direction parallel to the direction of the ribs (e.g., up and down with respect to FIG. 2D). This may provide numerous advantages, including increasing the comfort and support of the shoe 100.

In various embodiments, the width of the elastic region 104 (e.g., a distance from the perimeter 116 to the boundary 234 contributes to the comfort of the shoe 100. In some cases, the width of the elastic region 104 is greater than about one centimeter. In some cases, the width of the elastic region 104 is greater than about two centimeters. Similar to the ribs 236, the width of the elastic portion may provide advantages, including increasing a comfort of the shoe 100 on a wearer's foot. For example, the elastic region 104 may apply a sufficient elastic force to the wearer's foot to secure the shoe 100 to the wearer's foot, while the width of the elastic region 104 distributes this elastic force across a great enough area to avoid discomfort to the user, such as deforming the user's skin, inhibiting circulation, and the like.

In some cases, the ribs 236 and the depressions 238 are formed by woven fibers. In various embodiments, the ribs 236 and the depressions 238 may be formed by a knit pattern, such as a 1×1 ribbed pattern, a 2×2 ribbed pattern, or the like. FIG. 2D illustrates example shapes and arrangements of ribs 236 and depressions 238. In various embodiments, the particular shapes and details of the ribs 236 and the depressions 238 may vary from what is shown in FIG. 2D. For example, the ribs 236 and/or the depressions 238 may include variations in texture or shape as a result of being formed from woven fibers. In some cases, the elastic region 104 includes different or additional features, such as dimples.

In some cases, the elastic region 104 (including the ribs 236 and the depressions 238) may be formed by a yarn comprising a mixture of man-made fiber (e.g., polyester), a bio-based fiber (e.g., eucalyptus fiber), and/or a yarn comprising an elastic polymer (e.g., elastane). For example, in some cases, the elastic region 104 includes a first yarn that is plied or pre-twisted yarn having three strands comprising polyester and eucalyptus fiber (e.g., TENCEL) and a second yarn comprising an elastic polymer. In some cases, different parts of the elastic portion may comprise different materials and/or yarn blends. For example, in some cases, the ribs 236 and the depressions 238 are formed using different materials or yarn blends.

Returning to FIG. 2B, the tread surface 220 may include one or more patterns or features to improve the traction of the shoe 100. In some cases, the tread surface 220 includes indentations and/or protrusions that define the patterns or features for improving traction. In some cases, the tread surface 220 includes sipe features 266 that are formed by siping (e.g., cutting slits in) the sole 108. The sipe features may improve the traction of the shoe 100, for example by expanding and creating additional surface area to contact the ground or other surface.

The sipe features 266 may increase a flexibility of the sole 108. For example, in an unworn configuration, the sole 108 may curve as shown in FIG. 2A, and the sipe features 266 may expand, allowing the sole to curve more under the same force (e.g., the elastic force exerted by the elastic region 104) as compared to a sole not having the sipe features.

In various embodiments, the sole 108 may be formed of any suitable material or combination of materials, including polyamides, polyethylene, polypropylene, polyurethane (e.g., thermoplastic polyurethane), and polyols. In some cases, the sole 108 is formed at least partially from a natural material, such as castor bean oil. As noted above, using bio-based materials may provide environmental benefits, including reduced emissions and ecological sustainability. The materials used to form the sole 108 may be selected so that the sole is sufficiently thin, pliable, and/or flexible to be curved by the elastic force exerted by the elastic region 104.

The sipe features 266 may be substantially closed when the shoe 100 is in the worn configuration (e.g., when at least portions of the sole 108 are substantially planar). The sipe features 266 may open as the sole 108 curves (e.g., in the unworn configuration or as the sole 108 curves during use of the shoe 100). The sipe features 266 opening as the sole 108 curves provides added flexibility of the sole 108, both during a transition from the worn configuration to the unworn configuration and during flexure of the sole 108 during use of the shoe 100 (e.g., as a user walks).

As shown in FIG. 2B, at least part of the intermediate section 224 does not include sipe features 266. In some cases, the part of the intermediate section 224 that does not include sipe features 266 curves less than other parts of the sole 108. This may provide an expanded area of the tread surface 220 that remains substantially planar or less curved than other parts of the sole in the unworn configuration. In some cases, this expanded area may contact the ground or another surface on which the shoe 100 is placed in the unworn configuration. The expanded area may allow the shoe 100 to balance on a surface because it is less curved than other parts of the sole 108. In some embodiments, the intermediate section 224 may include sipe features. Similarly, in some embodiments, the shoe 100 may balance on a part of the sole 108 that includes sipe features.

As noted above, the shoe 100 may define a cavity 112 adapted to receive a wearer's foot. FIG. 3A illustrates a top view of the example shoe 100, including the cavity 112, the opening 114, and the perimeter 116 of the opening. As shown in FIG. 3A, the elastic region 104 may include one or more areas of tight curvature (e.g., curved sections 340 and 350) located along the perimeter 116.

The curved section 340 of the elastic region 104 may extend from a first location 342 along the perimeter 116 to a second location 344 along the perimeter 116. The curved section 340 may be configured to extend along a top of a wearer's foot. In some cases, the curved section defines a continuous curve between the first location 342 and the second location 344. In some cases, the curved section 340 defines a curve of at least about 100 degrees (e.g., an angle between a line tangent to the perimeter 116 at the first location 342 and a line tangent to the perimeter 116 at the second location 344 is at least about 100 degrees). In some cases, the curved section 340 defines a curve of between about 160 and about 190 degrees (e.g., an angle between a line tangent to the perimeter 116 at the first location 342 and a line tangent to the perimeter 116 at the second location 344 is between about 160 and about 190 degrees). The curved section 350 of the elastic region 104 may be configured to extend at least partially around a heel of the wearer's foot. In some cases, the curved section defines a continuous curve partially around the heel of the wearer's foot.

The curved sections 340 and 350 may provide advantages, including allowing the elastic region 104 to define an edge along the perimeter 116 that is smooth and unbroken about the entire perimeter 116 with no abrupt angles or discontinuities. In some cases, this allows the shoe 100 to have a softer silhouette and be more aesthetically pleasing than traditional shoes.

The elastic region 104 may include modulated sections (e.g., curved sections 340 and 350 or other sections of the elastic region) for which a curvature and/or elasticity is modulated using one or more techniques or structures to define and/or alter the curvature and/or elasticity of the modulated sections. For example, the curvature and/or elasticity of the curved section 340 may be modulated by a knit pattern of the curved section, as discussed in more detail below with respect to FIG. 3B. The curvature and/or elasticity of the curved section 350 may be modulated by a heel lining or other lining, as discussed in more detail below with respect to FIG. 5. These are examples of ways to modulate the curvature and/or elasticity of the modulated sections of the elastic region 104, and may be interchangeable. Additionally or alternatively, the curvature and/or elasticity of the modulated sections of the elastic region 104 may be modulated by including different or alternative materials and/or yarn blends. For example, the curvature and/or elasticity of the modulated sections of the elastic region 104 may be modulated by including a yarn comprising a thermoplastic material. In various embodiments, the modulated sections of the elastic region 104 may define or reinforce a shape and/or structure of the shoe 100.

Figure 3B:
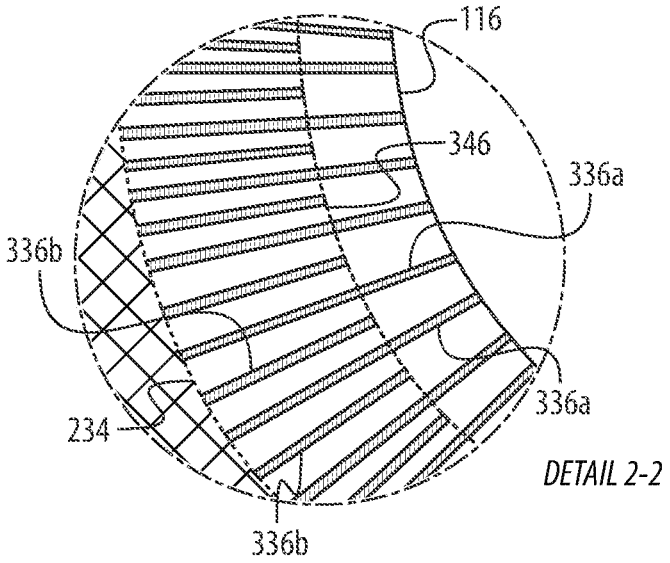
FIG. 3B illustrates a detail view of area 2-2 of FIG. 3A.

In some cases, the structure of the elastic region 104 in the curved section 340 may be different than other sections of the structure of the elastic region 104. For example, the curved section 340 may have different materials, yarn blends, and/or knit pattern(s). FIG. 3B illustrates a detail view of section 2-2 of FIG. 3A. As shown in FIG. 3B, the curved section 340 of the elastic region 104 includes ribs 336*a* and 336*b*. As noted above, the ribs 336*a* and 336*b* extend from a boundary 234 between the elastic region 104 toward the perimeter 116. In some cases, the ribs 336*b* do not extend the entire distance between the boundary 234 and the perimeter 116. For example, as shown in FIG. 3B, each of the ribs 336*a* extends to the perimeter 116, while each of the ribs 336*b* extends to a position between the boundary 234 and the perimeter. In some cases, the each of the ribs 336*b* extends to a position along an intermediate boundary 346 within the elastic region 104. The ribs 336*b* may be formed by altering a knit pattern at the intermediate boundary 346. For example, one or more stitches may be skipped to create a curved shape of the curved section 340.

In some cases, the ribs 336*a* and 336*b* alternate, such that each ribs 336*a* is positioned between two ribs 336*b* and each rib 336*b* is positioned between two ribs 336*a*. Said another way, pairs of adjacent ribs 336 may include a rib 336*a* and a rib 336*b*. The ribs 336*a* and 336*b* may allow the curved section 340 of the elastic region 104 to remain substantially flat instead of forming creases or bends as the elastic region curves as shown in FIGS. 3A and 3B. In some cases, if the ribs 336*b* were to extend to the perimeter 116 like the ribs 336*a*, the ribs 336*a* would bunch and cause creases or folds as the elastic region 104 curves. Omitting or shortening more ribs may result in a tighter curve. For example, if two ribs 336*b* are positioned between each rib 336*a*, the degree of curvature of the elastic region 104 may increase.

In some cases, the ribs 336*a* and 336*b* improve the comfort and durability of the shoe 100 by allowing the curved section 340 of the elastic region 104 to lay flat against a wearer's foot instead of forming creases or bends as the elastic region curves. This may improve the comfort of the shoe 100 by allowing the shoe to be more secure on the wearer's foot, and by preventing pressure points that rub and cause discomfort. Additionally, this may improve the durability of the shoe 100 by avoiding folds or creases in the elastic region 104 that could weaken the materials over time.

Returning to FIG. 3A, in some cases, an insole 118 may be positioned in the cavity 112, and may define at least a portion of the interior surface of the shoe 100 that surrounds the cavity. For example, the insole 118 may define a foot bed configured to receive and contact a bottom surface of a foot of the wearer. The insole 118 may be adapted to be positioned between the wearer's foot and the sole 108 to cushion the wearer's foot during wear. The insole 118 may cooperate with the upper portion 102 and one or more additional components of the shoe 100 to define the interior surface of the shoe 100.

In various embodiments, the insole 118 may include an insole surface defining a portion of the interior surface of the shoe 100 and a bottom portion that provides cushioning to the wearer's foot. The insole surface may be formed of any suitable material or combination of materials, including wool, cotton, polyester, nylon, and the like. The bottom portion may be formed of any suitable material or combination of materials, including polyamides, polyethylene, polypropylene, polyurethane (e.g., thermoplastic polyurethane), ethyl vinyl acetate, and polyols. In some cases, the bottom portion is formed at least partially from a bio-based material, such as castor bean oil. As noted above, using bio-based materials may provide environmental benefits, including reduced emissions and ecological sustainability.

In some cases, the insole 118 includes a marking 348 that is attached to the insole surface of the insole. The marking 348 may be designed to not interfere with the comfort or function of the insole 118. For example, the marking 348 may be designed to avoid adhering to a foot or sock contacting the insole 118.

In various embodiments, the marking 348 may be formed of any suitable material or combination of materials, including polyamides, polyethylene, polypropylene, polyurethane, and polyols. In some cases, the marking includes a thermoplastic material (e.g., thermoplastic polyurethane). The marking 348 may be bonded or otherwise attached to the insole surface of the insole 118, for example using adhesives, heat treatment, high frequency welding and the like.

In some cases, the marking 348 includes a first layer formed of a thermoplastic material and one or more additional layers of ink. In some cases, the marking 348 may be formed using a sheet of thermoplastic material having a thickness between 25 micrometers and 75 micrometers. One or more layers of ink may be applied to the sheet of thermoplastic material, for example using a screen-printing process, to form a logo or other design on the marking 348. In some cases, five or more layers of ink are applied to the sheet of thermoplastic material, with each layer being allowed to dry between applications. The ink may be applied to multiple sections along the sheet of thermoplastic material, and the multiple sections may be separated (e.g., die cut) to form multiple markings 348 for use in multiple shoes 100.

In some cases, the marking 348 is attached to the insole surface of the insole 118 using high frequency welding. In some cases, a high frequency welding mold may be heated to between about 100 and about 150 degrees Celsius and the marking 348 may be pressed against the insole surface of the insole 118 using the mold to attach the marking to the insole. In some cases, the marking 348 may be pressed against the insole surface of the insole 118 for a duration between about 1 and about 10 seconds. In some cases, the duration of the pressing may be varied based on environmental factors at the location of manufacturing, such as air temperature, humidity, and the like. For example, the duration of the pressing may be 2 seconds if the air temperature is above a threshold (e.g., about 20 degrees Celsius) or 3 seconds if the air temperature is below the threshold. Similarly, the duration of the pressing may be 2 seconds if the humidity is above a threshold (e.g., about 50% relative humidity) or 3 seconds if the humidity is below the threshold. Following the pressing, the insole 118 and marking 348 may be cooled at room temperature. In some cases, the cooling time is between 1 and 10 seconds.

As noted above, the upper portion 102 may be formed at least partially using bio-based materials, such as eucalyptus fiber, which is a more sustainable and environmentally friendly material than materials used in many traditional shoes. In addition, the upper portion 102 being constructed from a continuous textile reduces the use of potentially harmful chemicals, such as adhesives, used in the shoe 100.

In various embodiments, different textile characteristics may be employed at different regions of the upper portion 102. Textile properties for one or more regions of the upper portion 102 may be selected to facilitate or otherwise enhance comfort and other textile characteristics. For example, it may be desirable for one or more regions of the upper portion 102 (e.g., the structural region 106 or one or more sub-regions thereof) to have a higher stiffness, bursting strength, tensile strength, or abrasive strength compared to other regions (e.g., the elastic region 104). Likewise, for example, it may be desirable for one or more regions of the upper portion 102 (e.g., the elastic region 104 or one or more sub-regions of the structural region 106) to have increased breathability, flexibility, and/or elasticity compared to other regions. In some cases, the shoe 100 includes multiple elastic regions 104 and/or structural regions 106, each of which may have different textile characteristics from one or more other regions. Similarly, in some cases, an elastic region 104 and/or a structural region 106 may include one or more sub-regions having different textile characteristics from one or more other regions or sub-regions. The different regions of the upper portion 102 cooperate to provide enhanced performance of the shoe 100 as a whole, including improved durability and comfort.

In various embodiments, desired textile characteristics for a region, including stiffness, breathability, bursting strength, tensile strength, and abrasive strength may be achieved by selecting textile properties that yield the desired textile characteristics.

In some cases, varying a thickness (e.g., distance from an interior surface to an exterior surface) and/or density (e.g., amount of yarn per area) of the upper portion 102 across different regions can be used to achieve desired textile characteristics. For example, in some cases, a first region (e.g., the structural region 106) of the upper portion 102 having a first thickness may have an increased stiffness, a higher bursting strength, a higher tensile strength, and/or a higher abrasive strength compared to a second region (e.g., the elastic region 104) having a second thickness less than the first thickness. Similarly, in some cases, a first region (e.g., the structural region 106) of the upper portion 102 having a first density may have an increased stiffness, a higher bursting strength, a higher tensile strength, and/or a higher abrasive strength compared to a second region (e.g., the elastic region 104) having a second density less than the first density.

The thickness and/or density of a region of the upper portion 102 may be determined by a thickness of fibers in the yarn used in the region, a thickness of strands of yarn used in the region, a number of plied or braided yarn strands in a plied yarn, a density of the knit pattern in the region, and the like. Accordingly, a first region (e.g., the structural region 106) of the upper portion 102 having a first thickness may have thicker fibers, thicker yarn, and/or a denser knit pattern compared to a second, less thick region (e.g., the elastic region 104). Similarly, a first region (e.g., the structural region 106) of the upper portion 102 having a first density may have thicker fibers, thicker yarn, and/or a denser knit pattern compared to a second, less dense region (e.g., the elastic region 104).

Whereas a thicker and/or denser region of the upper portion 102 may be stiffer, have a higher bursting strength, a higher tensile strength, and/or a higher abrasive strength, a thinner and/or less dense region of the upper portion 102 may be more breathable (e.g., have a higher air permeability), more flexible, and/or have a greater elasticity. As such, some regions of the upper portion 102 may be thinner and/or less dense to achieve greater elasticity, flexibility, and breathability, which may improve the comfort of the shoe 100 by allowing moisture evaporation from the wearer's foot.

In some cases, the types of fibers and fiber ratio (e.g., the ratio of different fibers) in a yarn and/or a yarn type may vary across different regions of the upper portion 102 to change a thickness and/or achieve desired textile characteristics, including tactile characteristics and durability characteristics. For example, a first region (e.g., the structural region 106) may include a first yarn having a first blend of fibers at a first ratio and a second region (e.g., the elastic region 104) may include a second yarn having a second blend of fibers at a second ratio. In some cases, plied yarns and/or multiple yarns are used in the same region. Plied yarns include multiple strands of yarn that are twisted or braided together to create a thicker yarn.

In some cases, one or more regions of the upper portion 102 include a thermoplastic material that is heated during the manufacturing process to change the textile characteristics within the regions. In some cases, the yarn used in one or more regions of the upper portion 102 include a coating (e.g., resin) or one or more fibers formed of a thermoplastic material. In some cases a film that includes a thermoplastic material is applied to one or more regions as part of the manufacturing process. The region may be heated as part of the manufacturing process, for example after the upper portion 102 is constructed, to change textile characteristics of the region. The regions containing thermoplastic material may be heated during the manufacturing process to activate (e.g., melt) the thermoplastic material to change the textile characteristics of the regions. In some cases, the thermoplastic material reduces an elasticity, increases a stiffness, increases abrasive strength, increases burst strength, and/or increases tensile strength of the region(s) to which it is applied. For example, in some cases, the thermoplastic materials may help to reduce stretching of the structural region 106. In some cases, the thermoplastic material may provide additional or alternative advantages, including stain and water resistance. Example thermoplastic materials include ethylene vinyl acetates (EVAs), polyamides, polyesters, and polyurethanes.

In some embodiments, the thermoplastic material, when melted, may fill spaces between loops within the knit pattern of the upper portion 102. In some cases, the thermoplastic material, when melted, may coat and/or be absorbed into the yarn and/or fibers forming the knit textile. Once the knit textile is cooled, the textile properties of the region(s) containing the thermoplastic material may differ from those other regions of the shoe 100. For example, the thermoplastic material may reduce bending or stretching of the knit textile to reduce an elasticity, increase a stiffness, increase a tensile strength, and/or increase a burst strength of the material. Similarly, the thermoplastic material may bond to, coat, or otherwise form a barrier around the textile and/or the yarn or fibers within the textile to prevent abrasion or other damage. In various embodiments, the thermoplastic material may not substantially change an appearance of the knit textile. For example, the thermoplastic material may not be visible once it has been melted into the knit textile. The thermoplastic material may be designed to melt or flow at temperatures above normal environmental temperatures, but below where the other materials in the upper portion 102 would scorch or burn.

In some cases, the upper portion 102 is heated to a temperature between about 220 degrees Celsius and about 300 degrees Celsius to activate (e.g., melt) the thermoplastic material, for example using a steam iron. Once the upper portion 102 cools to a temperature between about 150 degrees Celsius and about 220 degrees Celsius, the thermoplastic material is integrated into the upper portion, and the upper portion may be heated to a temperature between about 200 degrees Celsius and about 220 degrees Celsius without re-melting the thermoplastic material or causing the textile properties of the upper portion to be further changed.

Traditional methods for achieving desired elasticity or other characteristics may include adding a separate component to a surface or between layers of the upper portion 102. In contrast, varying the textile properties of a continuous textile that forms the upper portion 102 avoids having multiple seams which may cause discomfort to a wearer of the shoe 100, and especially a wearer wearing the shoe without socks. Additionally, avoiding having a separate component reduces possible failure points (e.g., seams) and improves the efficiency of manufacturing and ability to recycle the shoe 100 by reducing the overall number of components of the shoe.

Figure 4A:
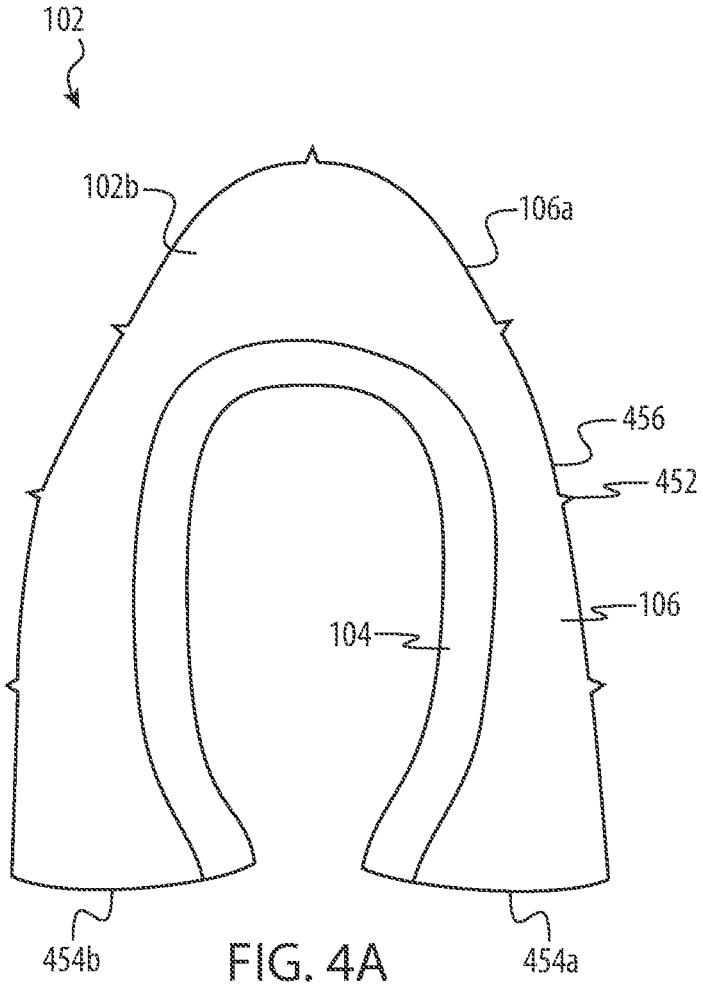
FIG. 4A illustrates an outer layer of the example knit textile upper portion of the example shoe of FIG. 1A, configured as a continuous textile in a pre-assembly configuration.
Figure 4B:
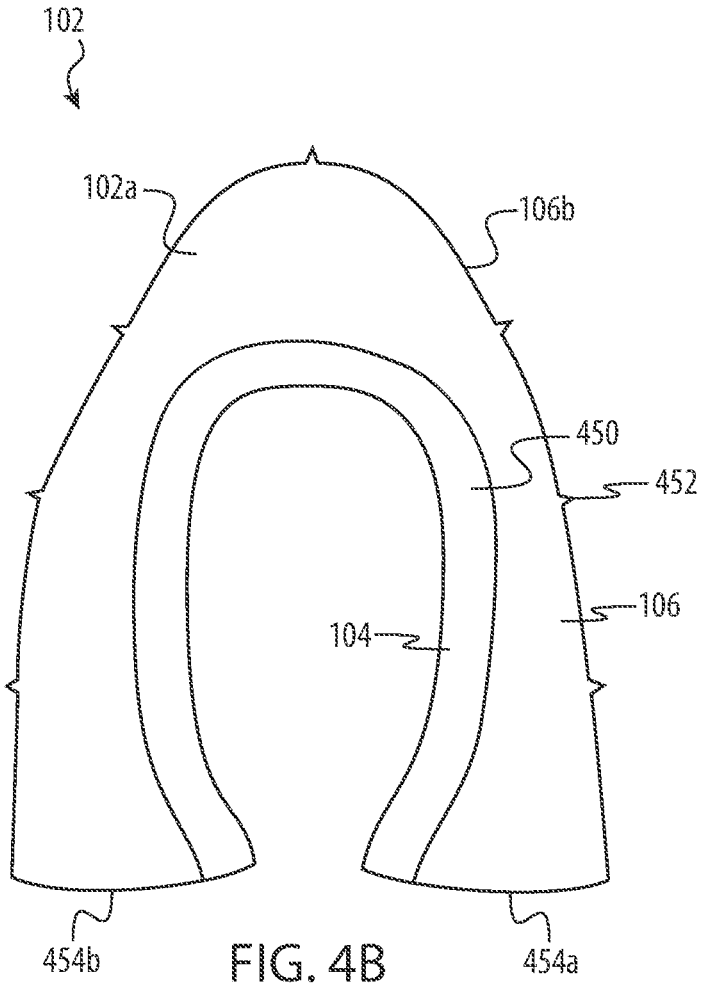
FIG. 4B illustrates an inner layer of the example knit textile upper portion of the example shoe of FIG. 1A, configured as a continuous textile in a pre-assembly configuration.

As discussed above, the upper portion 102 may be formed from a continuous knit textile. FIGS. 4A and 4B illustrate the example knit textile upper portion 102 as a continuous textile in a pre-assembly configuration. FIGS. 4A and 4B illustrate the elastic region 104 and the structural region 106 of the upper portion 102. FIG. 4A illustrates a first surface of the upper portion 102 that forms the exterior surface 102*a* of the upper portion as discussed in more detail below with respect to FIG. 6. FIG. 4B illustrates a second surface of the upper portion 102 opposite the first surface that forms the interior surface 102*b* of the upper portion as discussed in more detail below with respect to FIG. 6.

As noted above, one or more regions of the upper portion 102 may include multiple layers. In some cases, the elastic region 104 includes one layer and the structural region 106 includes two layers. FIG. 4A illustrates an outer layer 106*a* of the structural region 106 that defines at least a portion of the exterior surface 102*a* of the upper portion 102. In some cases, the outer layer 106*a* cooperates with the elastic region 104 to define the exterior surface 102*a*. FIG. 4B illustrates an inner layer 106*b* of the structural region 106 that defines at least a portion of the interior surface 102*b* of the upper portion 102. In some cases, the inner layer 106*b* cooperates with the elastic region 104 to define the interior surface 102*b*. In some cases, the outer layer 106*a* and/or the inner layer 106*b* are continuously knit with the elastic region 104. As noted above, a "continuous textile" may refer to a textile that is knit or otherwise formed as a single, unitary piece, in which an entire top surface is defined by a single piece and an entire bottom surface is defined by a single piece. The pieces that define the top surface and the bottom surface may be different layers of the textile, or one piece may define the entire top surface and the entire bottom surface. As a result, a continuous textile does not have multiple adjacent sections with seams therebetween.

In some cases, as noted above, the textile properties may be different in different layers of the upper portion 102 and/or in different regions of the upper portion 102. For example, types and amounts of yarn used in each region and each layer may vary. With reference to FIG. 4A, the structural region 106 in the outer layer 106*a* may include a yarn comprising a mixture of man-made fiber (e.g., polyester) and a bio-based fiber (e.g., eucalyptus fiber) and a yarn comprising a thermoplastic material. For example, in some cases, the structural region 106 in the outer layer 106*a* includes a first yarn that is plied or pre-twisted yarn having three strands (e.g., ends) comprising polyester and eucalyptus fiber (e.g., TENCEL), a second yarn that includes one strand comprising polyester and eucalyptus fiber (e.g., TENCEL), and a third yarn formed of thermoplastic nylon (e.g., 100D hot melt yarn).

In some cases, the content of the first yarn may be between about 60% and about 80% eucalyptus fiber (e.g., TENCEL) and between about 20% and about 40% polyester. For example, the content of the first yarn may be about 70% eucalyptus fiber and about 30% polyester. This blend of fibers in a yarn may provide advantages, including a desired textile feel, bursting strength, abrasive strength. In some cases, the blend of fibers may be optimized or otherwise enhanced to balance absorption and distribution of moisture. In some cases, the eucalyptus fiber may absorb or distribute moisture across an area of the textile, and the polyester may wick moisture to cause it to be evaporated. In some cases, the thermoplastic nylon may increase a stiffness and/or abrasive strength of the structural region 106.

In some cases, the elastic region 104 includes a fourth yarn comprising a polymer (e.g., polyester) and an elastic polymer (e.g., elastane). In some cases, the fourth yarn comprises between about 75 and about 85% polyester and between about 15% and about 25% elastane. For example, the fourth yarn may be MF-193 comprising about 79% polyester and about 21% SPANDEX. In some cases, the elastic polymer increases an elasticity of the elastic region 104. In some cases, the elastic region 104 does not include a thermoplastic material, which contributes to increased elasticity, flexibility (reduced stiffness), and breathability. In some cases, the polymer is formed from recycled materials, such as recycled polyester from plastic bottles. As noted above, using recycled materials instead of new materials reduces waste sent to landfills and incinerators and conserves natural resources, prevents pollution, and saves energy related to the collection and processing of new raw materials.

With reference to FIG. 4B, the structural region 106 in the inner layer 106*b* may include the first, second, and third yarns discussed above and a fifth yarn comprising a polymer (e.g., nylon) and an elastic polymer (e.g., nylon and elastane). In some cases, the fifth yarn comprises between about 85 and about 95% nylon and between about 5% and about 15% elastane. For example, the fourth yarn may be H2070 nylon/spandex comprising about 92% nylon and about 8% SPANDEX. In some cases, one strand of the fourth yarn may be pre-twisted with the three strands of the first yarn.

Figure 5:
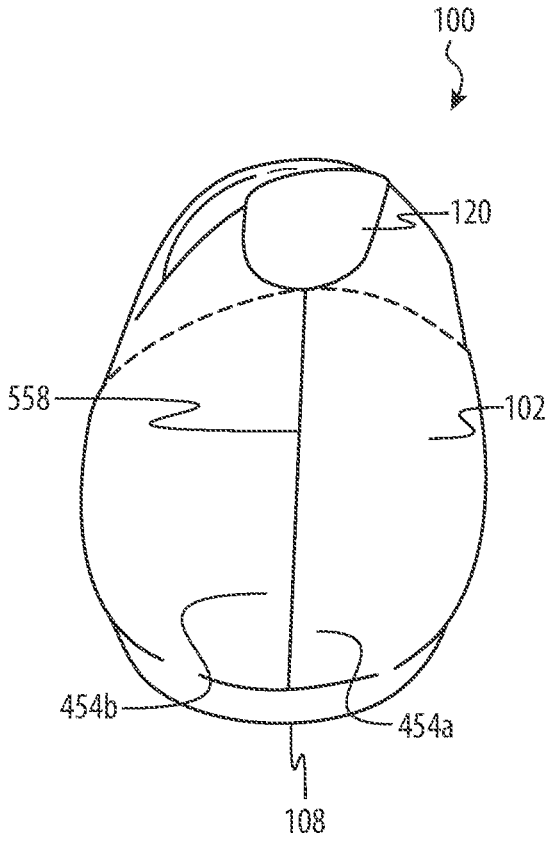
FIG. 5 illustrates a rear view of the example shoe of FIG. 1A.

As noted above, in various embodiments, the shoe 100 may be assembled by forming the upper portion 102 into a desired three-dimensional shape, for example using a mold. An edge 454*a* of the upper portion 102 may be attached to an edge 454*b* of the upper portion to hold the shape of the upper portion and construct the shoe 100. FIG. 5 illustrates a rear view of the example shoe 100 showing the edges 454*a* and 454*b* attached at a seam 558. The edges 454*a* and 454*b* may be attached using any suitable fastening technique, including adhesives, stitching, bonding, and the like.

The shaped upper portion 102 may be attached to the sole 108 using an adhesive or other fastening method. As described in more detail below with respect to FIG. 6, the shoe 100 may include a strobel that encloses the bottom of the upper portion 102. In some cases, the strobel is attached to the sole 108 and the upper portion 102. In some cases, the strobel may be attached to the upper portion 102 along an edge 456 of the upper portion. For example, a perimeter of the strobel may be attached to the edge 456 of the upper portion 102. In some cases, as shown in FIGS. 4A and 4B, the upper portion 102 may include attachment features 452 for attaching the upper portion 102 to the strobel. In some cases, the strobel has attachment features that correspond to the attachment features 452 of the upper portion 102.

An adhesive may be applied between a top surface of the sole 108 and a bottom surface of the strobel and/or a surface of the upper portion 102 at or near a perimeter of the sole to attach the sole to the upper portion. In some cases the strobel is omitted and the upper portion 102 is attached directly to the sole 108 using adhesive or another fastener. In some cases, the strobel may be a part of the upper portion 102. Following attachment of the upper portion 102 to the sole, an insole (e.g., insole 118) may be inserted into the cavity. As noted above, an upper surface of the insole may define a portion of the interior surface of the shoe 100. An interior surface 102*b* of the upper portion 102 may define an additional portion of the interior surface of the shoe 100.

Figure 6:
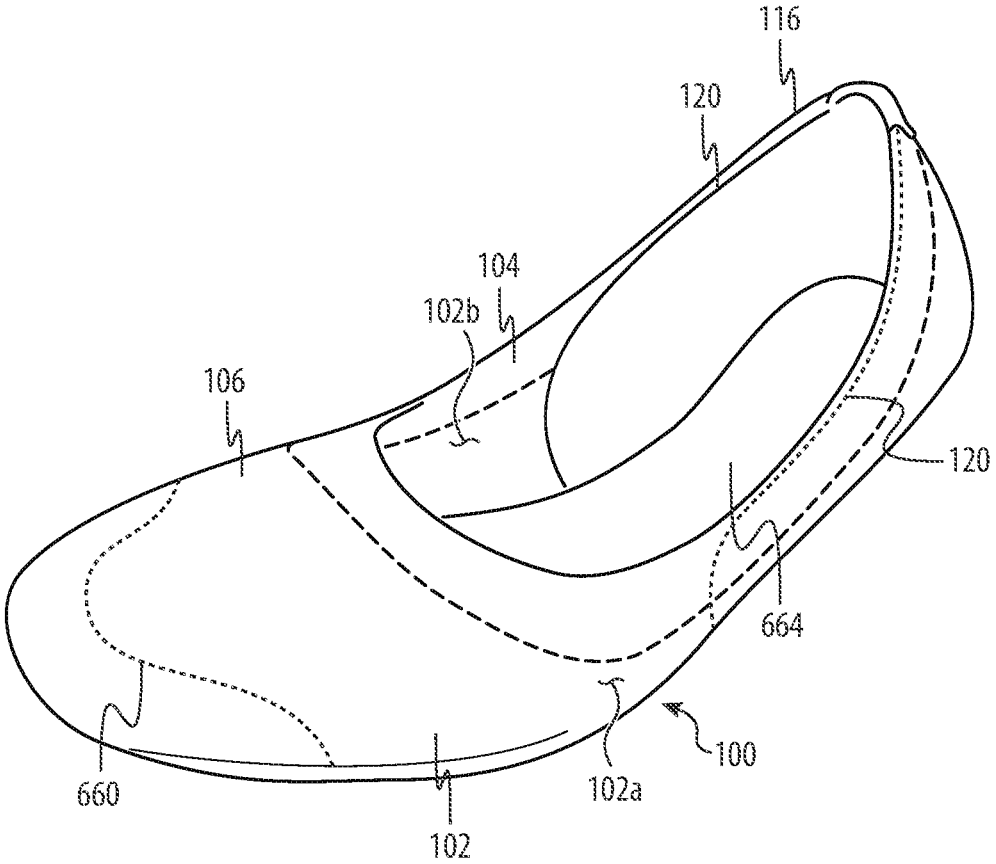
FIG. 6 illustrates example heel and toe liners in the example shoe of FIG. 1A.

As noted above, the shoe 100 may include one or more linings to improve the comfort or durability of the shoe. FIG. 6 illustrates example positions of a toe lining 660 and a heel lining 120 in the shoe 100. In various embodiments, the toe lining 660 and the heel lining 120 may reduce wear of the upper portion 102, for example by reducing abrasion in areas that are prone to greater amounts of friction from a wearer's foot. In some cases, the heel lining 120 may additionally or alternatively provide friction to retain the wearer's foot in the shoe 100 during wear.

As shown in FIG. 6, the toe lining 660 (shown in phantom) may be positioned along and attached to a first part of the interior surface 102*b* of the upper portion 102 in a forward section of the shoe 100 and within the cavity. The location of the toe lining 660 may be particularly prone to friction and abrasion by a wearer's toes during wear. The toe lining 660 may reduce wear that results from this friction by providing a barrier along the upper portion 102. In addition, the toe lining 660 may improve the comfort of the shoe 100 by providing a softer, smoother, slicker, or otherwise more comfortable surface for the wearer's toes to contact during wear, including a wearer wearing the shoe 100 without a sock. In some cases, the toe lining 660 extends along the interior surface 102*b* to an area that the wearer's toes do not contact during wear, which may improve the comfort of the shoe 100 by avoiding the wearer's toes contacting an interface or edge of the toe lining.

The heel lining 120 may be positioned along and attached to a second part of the interior surface 102*b* of the upper portion 102 in a rear section of the shoe 100. The area where the heel lining 120 is located may be particularly prone to friction and abrasion by a wearer's foot during wear. In various embodiments, the area where the heel lining 120 is located may be subject to more abrasion and other damage than other parts of the interior surface 102*b* due to its location near the back of the shoe 100. For example, the area where the heel lining 120 is located may be rubbed while a wearer puts on or takes off the shoe 100. Similarly, the area where the heel lining 120 is located may be rubbed by the wearer's heel while the shoe 100 is worn.

The heel lining 120 may reduce wear that results from this friction by providing a barrier along the upper portion 102. In addition, the heel lining 120 may improve the comfort of the shoe 100 by providing a softer surface for the wearer's foot to contact during wear, including a wearer wearing the shoe 100 without a sock. In some cases, the heel lining 120 provides increased friction to retain the wearer's foot in the shoe 100 during wear. In some cases, for example as shown in FIG. 5, the heel lining extends around the perimeter 116 of the opening in the upper portion 102 and along the exterior surface 102*a* of the upper portion.

In some cases, at least a portion of the heel lining 120 is positioned along a portion of the structural region 106. In some cases, the heel lining 120 extends along portions of the elastic region 104 and the structural region 106. In some cases, as shown in FIG. 6, at least a portion of the heel lining 120 is positioned along and attached to one or more portions of the elastic region 104. As noted above, the elastic region 104 may have a first elasticity that is greater than a second elasticity of the structural region 106. In some cases, the heel lining 120 being positioned along and attached to the portion(s) of the elastic region 104 constrains or otherwise reduces an elasticity of those portions of the elastic region. In some cases, for example, a portion of the elastic region 104 along which the heel lining 120 is positioned has a third elasticity that is less than the elasticity of other portions of the elastic region (e.g., the first elasticity). This may improve the performance of the shoe, including the comfort and durability. For example, the reduced elasticity may maintain a structure of the areas of the upper portion around the rear of the shoe 100, which may result in increased comfort and/or durability of the shoe.

In some cases, the heel lining 120 extends along the interior surface 102*b* in the elastic region 104, but does not extend all the way to the perimeter 116, such as shown in FIG. 6. This may allow the top portion of the elastic region 104 that does not have the heel lining 120 positioned along it to be unconstrained and stretch more than the region along which the heel lining is positioned. This may improve the comfort and/or durability of the shoe 100 by making it easier for a wearer to slide his or her foot in and out of the shoe.

In some cases, the toe lining 660 and/or the heel lining 120 are part of the upper portion 102 and have different textile properties to achieve the desired performance, including durability. In some cases, the toe lining 660 and/or the heel lining 120 are separate components that are attached to the upper portion 102. For example, the toe lining 660 and/or the heel lining 120 may be formed from a wear-resistant material (e.g., wool, polyester, microfiber, or the like) that is attached (e.g., bonded, sewn, or glued) onto the interior surface 102*b* of the upper portion 102. The toe lining 660 and/or the heel lining 120 may have higher abrasive strength or other improved textile characteristics compared to the upper portion 102. In some cases, the heel lining 120 covers the portion of the seam 558 on the interior surface 102*b* of the upper portion 102 to improve the comfort of the shoe and/or reinforce the seam 558. For example, the heel lining 120 may prevent the seam 558 from rubbing or otherwise irritating the wearer's foot, including a wearer wearing the shoe 100 without a sock. As shown in FIG. 5, the heel lining 120 may extend around an edge of the elastic region 104 and along opposing surfaces of the elastic region 104 to, for example, reinforce the seam 558 in the elastic region. The heel lining 120 may cover portions of the seam 558 along the interior surface 102*b* or the exterior surface 102*a* of the shoe 100 so that the portions of the seam are not visible. In some cases, the shoe 100 may include heel padding (e.g., a foam padding), for example between the heel lining 120 and the upper portion 102 to improve the comfort of the shoe.

As noted above, in some cases, one or more regions of an interior surface of the shoe 100 may have different textile properties than regions of the exterior surface and/or other regions of the interior surface. FIG. 6 shows part of the interior surface 102*b* of the upper portion 102, which may be brushed or otherwise treated to soften the interior surface. In some cases, a region of the upper portion 102 may have different textile characteristics on an exterior surface than it has on an interior surface. For example, the tactile feel may be softer on the interior surface 102*b* than on an exterior surface 102*a* at the same location of the upper portion 102. The interior surface 102*b* may provide advantages including improving the comfort of the shoe 100 to a wearer, including a wearer wearing the shoe without a sock. The different textile characteristics of the interior surface 102*b* may be achieved by processing the textile (e.g., brushing or flocking) differently on each surface and/or using different materials at the different surfaces. In some cases, the toe lining 660 and/or the heel lining 120 are brushed, flocked, or otherwise processed, similar to the interior surface 102*b*.

In some cases, one or more regions of the interior surface 102*b* are brushed to soften the tactile feel of the regions. For example, the areas of the interior surface 102*b* that are not covered by the toe lining 660 or the heel lining 120 may be brushed to soften the tactile feel of the interior surface 102*b*, for example to improve the comfort of a foot in the shoe 100. In some cases, the areas of the interior surface 102*b* that are covered by the toe lining 660 or the heel lining 120 are brushed as well, for example prior to installation of the linings. In some cases, the areas of the interior surface 102*b* that are covered by the toe lining 660 or the heel lining 120 are not brushed. In some cases, one or more regions of the exterior surface 102*a* of the upper portion 102 are brushed. In some cases, the exterior surface 102*a* of the upper portion 102 is not brushed.

In some cases, the interior surface 102*b* is brushed after the upper portion 102 is knit and before the upper portion is attached to the sole 108. For example, the interior surface 102*b* may be brushed using a brushing machine while the upper portion 102 is in the pre-assembly configuration shown in FIGS. 4A and 4B.

In some cases, the interior surface 102*b* may include different fiber types, fiber ratios, and/or yarn types compared to the exterior surface 102*a* of the upper portion 102. In some cases, the knit structure may include different fiber types, fiber ratios, and/or yarn types at each surface. In some cases, as discussed above, the upper portion 102 may include different layers defining the interior surface 102*b* and the exterior surface 102*a*. The fiber types, fiber ratios, and/or yarn types at the exterior surface 102*a* may be selected for their ability to resist abrasion and other damage, and the fiber types, fiber ratios, and/or yarn types at the interior surface 102*b* may be selected for their tactile feel (e.g., softness).

The positions and textile properties of the elastic region 104, the structural region 106, the toe lining 660, and the heel lining 120 discussed herein are examples and are not meant to be limiting. The upper portion 102 may include more or fewer regions or linings having different textile properties, and the regions or linings may be located in different positions of the upper portion 102. Additionally, any combination of one or more of the textile properties discussed herein may be varied across different regions or linings. The different textile properties of the different regions or linings of the upper portion 102 may be achieved using a variety of techniques appropriate for the particular desired textile properties, including, but not limited to, material selection, manufacturing techniques, pre-processing techniques, post-processing techniques, and the like.

As noted above, the shoe 100 may include a strobel 664 that encloses the bottom of the upper portion 102. In some cases, the strobel 664 may be attached to the upper portion 102 along an edge of the upper portion (e.g., edge 456 as shown in FIGS. 4A and 4B). For example, a perimeter of the strobel 664 may be attached to the edge of the upper portion 102. In some cases, the upper portion 102 may include attachment features (e.g., attachment features 452 shown in FIGS. 4A and 4B) for attaching the upper portion 102 to the strobel 664. In some cases, the strobel 664 has attachment features that correspond to the attachment features of the upper portion 102.

To assemble the shoe 100, an adhesive or other fastener may be applied between a top surface of the sole 108 and a bottom surface of the strobel 664 and/or a surface of the upper portion 102 at or near a perimeter of the sole to attach the sole to the upper portion. In some cases the strobel 664 is omitted and the upper portion 102 is attached directly to the sole 108 using adhesive or another fastener. In some cases, the strobel 664 may be a part of the upper portion 102 (e.g., part of a continuous knit textile). Following attachment of the upper portion 102 to the sole 108, an insole (e.g., insole 118) may be inserted into the cavity such that the strobel 664 is positioned between the insole and the sole.

As noted above, the upper portion 102 may define a continuous single exterior surface 102*a* around an opening to the cavity with one seam and no holes through the knit textile forming the upper portion. The elastic region 104 may retain the shoe to a wearer's foot in the absence of laces or other fastening mechanisms common on traditional footwear.

As noted above, many embodiments described herein reference a shoe having a knit textile upper portion including an elastic region. It may be appreciated, however, that this is merely one example; other configurations, implementations, and constructions are contemplated in view of the various principles and methods of operations—and reasonable alternatives thereto—described in reference to the embodiments described above.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A shoe, comprising:

a sole defining a front tip and a front lobe extending from the front tip; and an upper portion attached to the sole, formed from a continuous knit textile, and defining an opening to a cavity of the shoe, the continuous knit textile comprising:

an elastic region configured to exert a first compressive force to a wearer's forefoot, the elastic region extending at least partially around the opening to the cavity and defining a ribbed knit pattern, the ribbed knit pattern positioned, in part, over the front lobe of the sole and adapted to extend at least partially over a metatarsal of the wearer's forefoot, the ribbed knit pattern comprising:

a first set of ribs extending a first distance; and a second set of ribs, each rib of the first set of ribs alternating with an adjacent rib of the second set of ribs, the second set of ribs extending a second distance less than the first distance; and a structural region configured to exert a second compressive force to the wearer's forefoot, the structural region at least partially surrounding the elastic region and having an elasticity less than an elasticity of the elastic region.

2. The shoe of claim 1, wherein the elastic region comprises:

a first section oriented to lie against a portion of a top of a wearer's foot and positioned over the front lobe;

a second section oriented to lie against a portion of a side of the wearer's foot; and a third section that provides a curved transition between the first section and the second section.

3. The shoe of claim 2, wherein the third section of the elastic region defines a smoothly curved edge.

4. The shoe of claim 3, wherein a curvature of the third section of the elastic region is modulated by the ribbed knit pattern.

5. The shoe of claim 3, wherein an elasticity of the third section of the elastic region is modulated by the ribbed knit pattern.

6. The shoe of claim 3, wherein a distance between the curved edge and a boundary between the elastic region and the structural region is at least 1 cm.

7. The shoe of claim 1, wherein:

the elastic region is formed from a yarn including an elastic polymer; and the structural region includes a yarn comprising eucalyptus fiber.

8. A shoe, comprising:

a sole defining:

a tread surface and a top surface opposite the tread surface; and an upper portion attached to the top surface of the sole and defining an opening to a cavity of the shoe, the upper portion comprising a continuous knit textile including:

an elastic region configured to exert a first compressive force to a wearer's forefoot, the elastic region at least partially defining a perimeter of the opening and comprising:

a ribbed knit pattern adapted to extend partially over a metatarsal of the wearer's forefoot, the ribbed knit pattern comprising a first set of ribs having a first length, and a second set of ribs having a second length less than the first length, each rib of the first set of ribs alternating with an adjacent rib of the second set of ribs;

a forward section having a first curvature at the perimeter; and a transition section extending from the forward section and having a second curvature, greater than the first curvature, at the perimeter; and a structural region at least partially surrounding the elastic region and configured to exert a second compressive force to the wearer's forefoot.

9. The shoe of claim 8, wherein the second curvature is modulated by the ribbed knit pattern.

10. The shoe of claim 8, wherein:

the elastic region meets the structural region at a boundary, and the ribs extend from the boundary to the perimeter of the opening.

11. The shoe of claim 8, wherein the structural region includes a yarn comprising a eucalyptus fiber and a recycled synthetic fiber.

12. The shoe of claim 8, wherein the opening is configured to at least partially expose a portion of a wearer's foot that includes a metatarsal.

13. The shoe of claim 12, wherein the forward section of the elastic region is configured to extend over a portion of a top of the wearer's foot.

14. A shoe, comprising:

a sole defining:

a top surface; and a tread surface; and an upper portion attached to the top surface of the sole, at least partially defining a cavity of the shoe, and comprising a continuous knit textile including:

an elastic region configured to apply a first compressive force to a wearer's forefoot and at least partially surrounding an opening into the cavity, defining at least a portion of a perimeter of the opening, and having a ribbed knit pattern configured to be positioned partially over a metatarsal of the wearer's forefoot, the ribbed knit pattern comprising:

a first set of ribs having a first length; and a second set of ribs having a second length less than the first length, each rib of the first set of ribs alternating with an adjacent rib of the second set of ribs; and a structural region configured to apply a second compressive force to the wearer's forefoot and comprising a natural fiber.

15. The shoe of claim 14, wherein;

the elastic region has a single layer structure; and the structural region has a multi-layer structure and a stiffness that is greater than a stiffness of the elastic region.

16. The shoe of claim 15, wherein the multi-layer structure comprises:

an outer layer defining at least a portion of an exterior surface of the upper portion; and an interior layer defining at least a portion of an interior surface of the upper portion, each of the outer layer and the interior layer comprising the natural fiber.

17. The shoe of claim 15, wherein the structural region further includes a thermoplastic polymer.

18. The shoe of claim 15, wherein the sole comprises a bio-based foam.

19. The shoe of claim 15, wherein in an unworn configuration of the shoe:

the elastic region is configured to exert an elastic force on the structural region.

20. The shoe of claim 14, wherein:

the ribbed knit pattern is a first ribbed knit pattern;

the first ribbed knit pattern defines a curved portion of the elastic region;

the elastic region includes a second ribbed knit pattern having a third set of ribs extending from the opening to a boundary between the elastic region and the structural region and a respective depression disposed between each two ribs of the third set of ribs.

* * * * *